US008248306B2

(12) United States Patent
Legay et al.

(10) Patent No.: US 8,248,306 B2
(45) Date of Patent: Aug. 21, 2012

(54) DUAL POLARIZATION PLANAR RADIATING ELEMENT AND ARRAY ANTENNA COMPRISING SUCH A RADIATING ELEMENT

(75) Inventors: Herve Legay, Plaisance du Touch (FR); Daniele Bresciani, Toulouse (FR); Renaud Chiniard, Mourvilles Basses (FR)

(73) Assignee: Thales, Neuilly-sur-Seine (FR)

( * ) Notice: Subject to any disclaimer, the term of this patent is extended or adjusted under 35 U.S.C. 154(b) by 359 days.

(21) Appl. No.: 12/578,831

(22) Filed: Oct. 14, 2009

(65) Prior Publication Data

US 2010/0156725 A1 Jun. 24, 2010

(30) Foreign Application Priority Data

Dec. 23, 2008 (FR) ..... 08 07401

(51) Int. Cl.
*H01Q 1/38* (2006.01)

(52) U.S. Cl. ..... 343/700 MS; 343/834

(58) Field of Classification Search ..... 343/700 MS, 343/909, 834
See application file for complete search history.

(56) References Cited

U.S. PATENT DOCUMENTS 6,061,025 A 5/2000 Jackson et al.
2009/0046017 A1* 2/2009 Foo ..... 343/700 MS

FOREIGN PATENT DOCUMENTS

CA 2218269 4/1999

OTHER PUBLICATIONS

A. Petosa et al., "Suppression of Unwanted Probe Radiation in Wideband Probe-Fed Microstrip Patches", Electronics Letters, Mar. 4, 1999, 2 pages, vol. 35—No. 5, IEE Stevenage, GB.

* cited by examiner

*Primary Examiner* — Dieu H Duong
(74) *Attorney, Agent, or Firm* — Baker & Hostetler LLP

(57) ABSTRACT

A dual-polarization planar radiating element having an external metal grid, at least one metal patch concentric with the external metal grid and a cavity separating the metal grid and the metal patch, the grid and the patch having a polygonal shape delimited by at least four pairwise opposite sides, and two orthogonal directions of polarization associated with two orthogonal electric fields Ev and Eh, at least one of the directions of polarization being parallel to two sides of the polygon. Each side of the metal patch parallel to a direction of polarization is linked electrically to a zone of the external grid where one of the electric fields Ev or Eh is a minimum. The invention exhibits the advantage of reducing the phenomenon of electrostatic discharges in the planar radiating elements without significantly modifying the response of the radiating element subjected to an orthogonally polarized wave.

11 Claims, 8 Drawing Sheets

DUAL POLARIZATION PLANAR RADIATING ELEMENT AND ARRAY ANTENNA COMPRISING SUCH A RADIATING ELEMENT

CROSS-REFERENCE TO RELATED APPLICATIONS

This application claims priority of French application no. FR 08/07401, filed Dec. 23, 2008, the disclosure of which is hereby incorporated by reference in its entirety.

FIELD OF THE INVENTION

The present invention relates to a dual-polarization planar radiating element in which the phenomenon of electrostatic discharges is minimized and to an array antenna comprising such a radiating element. The invention applies to any type of antenna comprising at least one dual-polarization planar radiating element, to the radiating arrays fitted to certain antennas and to the array antennas onboard a spacecraft, for example on a satellite, such as reflectarray antennas or phase-controlled array antennas.

BACKGROUND OF THE INVENTION

An array antenna, such as for example a reflectarray antenna or a phase-controlled array antenna (also known as a phased array antenna), comprises a set of elementary radiating elements assembled in a one-dimensional or two-dimensional radiating array making it possible to increase the directivity and the gain of the antenna. In reflectarray antennas, the elementary radiating elements of the array often consist of an arrangement of patches and slots whose dimensions vary. The shape of the radiating elements, for example square, circular, hexagonal, is generally fixed and unique for the array. The dimensions of the radiating elements are adjusted so as to obtain a chosen radiation pattern when they are illuminated by a primary source. In phase-controlled array antennas, the distributing of the signal to the radiating elements of the array is done with the aid of a beam-forming distributor.

The elementary radiating elements can consist of a structure with cavity and radiating slots which is mounted on a metal plane or of a planar structure comprising a metal radiating patch printed on the surface of a dielectric substrate mounted on a metal plane, the metal patch possibly comprising one or more slots as represented for example in FIG. 1. The radiating slots can be made of a dielectric material or a composite material such as the superposition of a honeycomb of printed fine dielectric substrates used as a skin of the composite material. However, in order for the antenna to be capable of supporting a space environment, it is necessary to ensure that the phenomena of electrostatic discharges between the radiating elements are minimized.

It is known to minimize the electrostatic discharges on a spacecraft by linking all the electrically conducting external surfaces and all the internal metal elements of the spacecraft to the main metal structure of the craft. For linearly polarized radiating elements, grounding can be achieved without any particular problem by connecting the radiating elements to an external metal grid by a metal wire along an axis of symmetry perpendicular to the direction of polarization.

However, for a radiating array consisting of elementary radiating elements of planar structure with dual polarization, it is necessary to take account of the polarization of the various radiating elements. Indeed, connecting the radiating elements directly together, for example by way of a metal wire, would affect the polarization and the operation of these elements and could destroy the resonances and cause the excitation of other higher modes. Furthermore, in the case of an array antenna, the matching of the radiating elements could be destroyed.

SUMMARY OF THE INVENTION

The aim of the present invention is to remedy this problem by proposing a dual-polarization planar radiating element in which the phenomenon of electrostatic discharges is minimized without disturbing the response of the radiating element subjected to an orthogonally polarized wave.

For this purpose, the subject of the invention is a dual-polarization planar radiating element, characterized in that it comprises an external metal grid, at least one metal patch concentric with the external metal grid and a cavity separating the metal grid and the metal patch, the grid and the patch having a polygonal shape delimited by at least four pairwise opposite sides, in that it comprises two orthogonal directions of polarization associated with two orthogonal electric fields, at least one of the directions of polarization being parallel to two sides of the polygon and in that each side of the metal patch parallel to a direction of polarization is linked electrically to a zone of the external grid where one of the electric fields is a minimum.

Advantageously, the polygonal shape of the metal patch is chosen from among a square, rectangle, cross, hexagon shape.

Advantageously, the planar radiating element comprises four pairwise orthogonal sides and each side of the metal patch parallel to a direction of polarization is linked respectively to a side of the external grid perpendicular to the said direction of polarization.

Preferably, each side of the metal patch parallel to a direction of polarization comprises a centre linked to a centre of a side of the external grid perpendicular to the said direction of polarization.

According to a particular embodiment, the metal patch can comprise several orthogonal slots forming a cross.

According to another embodiment, the metal patch comprises an external annular patch, at least one internal patch concentric with the external annular patch and at least one annular slot separating the internal and external patches, the internal and external patches having the same polygonal shape, each side of the internal patch parallel to a direction of polarization being linked to a side of the external annular patch perpendicular to the said direction of polarization.

Optionally, the internal patch can comprise several orthogonal slots forming a central cross.

Preferably, each side of the internal patch parallel to a direction of polarization comprises a centre linked to a centre of a side of the external annular patch perpendicular to the said direction of polarization.

According to a particular embodiment, the polygonal shape of the metal patches is a cross and the external grid has a square shape.

According to another particular embodiment, the metal patch comprises an external annular patch, at least one internal patch concentric with the external annular patch and at least one annular slot separating the internal and external patches, the internal and external patches having a hexagon shape comprising two sides parallel to a direction of polarization and four sides inclined obliquely with respect to the said direction of polarization and linked pairwise by a vertex, each side of the external metal patch parallel to the said direction of polarization being linked electrically to a vertex of the internal patch and each side of the internal patch parallel to the said direction of polarization being linked electrically to a vertex of the external metal patch.

The invention also relates to an array antenna comprising at least one dual-polarization planar radiating element, the external metal grid of each radiating element being linked to a metal ground plane of the array.

BRIEF DESCRIPTION OF THE DRAWINGS

Other features and advantages of the invention will be clearly apparent in the subsequent description given by way of purely illustrative and nonlimiting example, with reference to the appended schematic drawings which represent.

DETAILED DESCRIPTION

Figure 1:
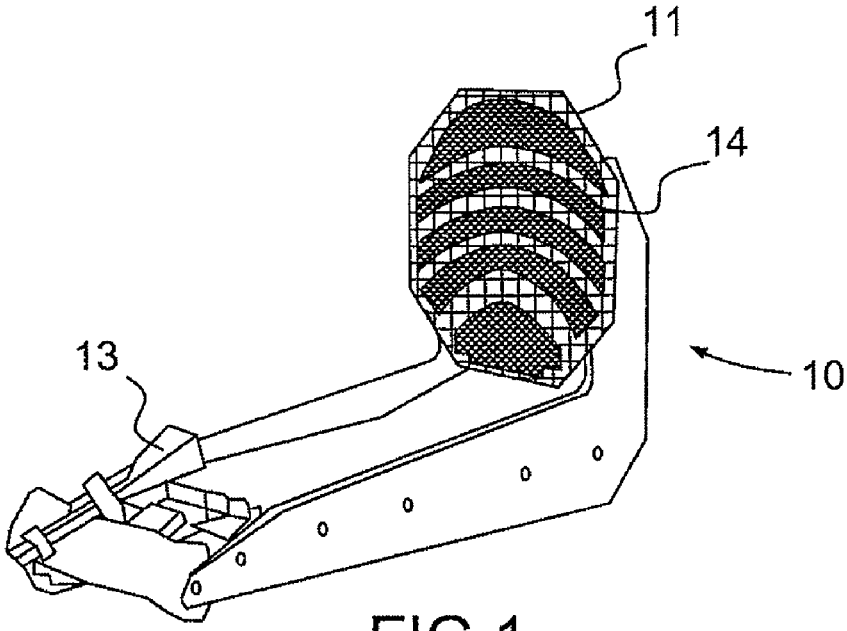
FIG. 1: a diagram of an exemplary array antenna.

FIG. 1 shows an exemplary array antenna 10 comprising a reflectarray 11 forming a reflecting surface 14 and a primary source 13 for illuminating the reflectarray 11 with an incident wave. The reflectarray comprises a plurality of elementary radiating elements arranged as a two-dimensional surface.

Figure 2:
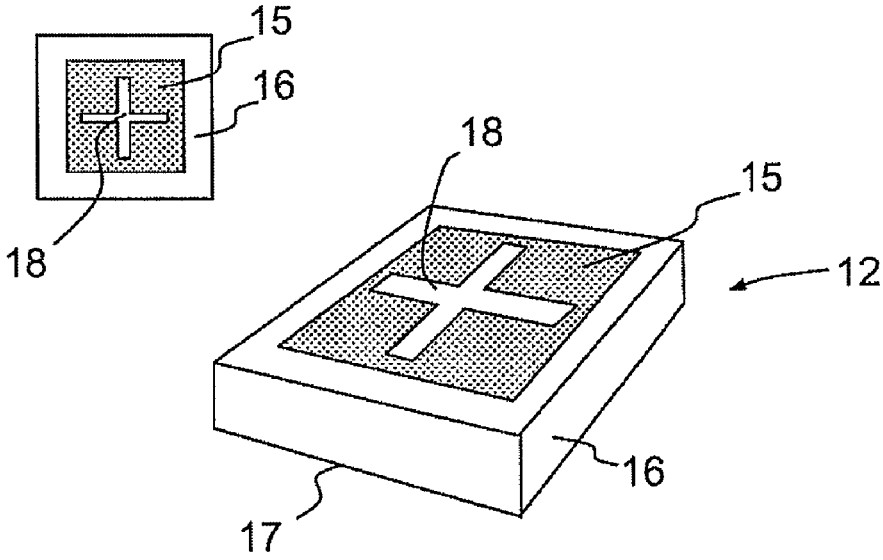
FIG. 2: a diagram of a first exemplary dual-polarization elementary radiating element made by planar technology.

In FIG. 2 is represented a first exemplary elementary radiating element 12 with dual polarization comprising a metal patch 15 printed on an upper face of a substrate 16 furnished with a metal ground plane 17 on its lower face, the substrate possibly being a dielectric material or a composite material consisting of a spacer material, for example in a honeycomb fashion, and of fine dielectric materials. The metal patch 15 comprises two slots 18 in the shape of a cross made at its centre. The shape of the elementary radiating elements 12 can be for example square, rectangular, hexagonal, circular, cross-shaped or any other geometric shape. The number of slots made can also be different from two and their disposition can be different from a cross. In FIG. 2 the slots have the same dimensions but they could be of different dimensions.

Figure 3A:
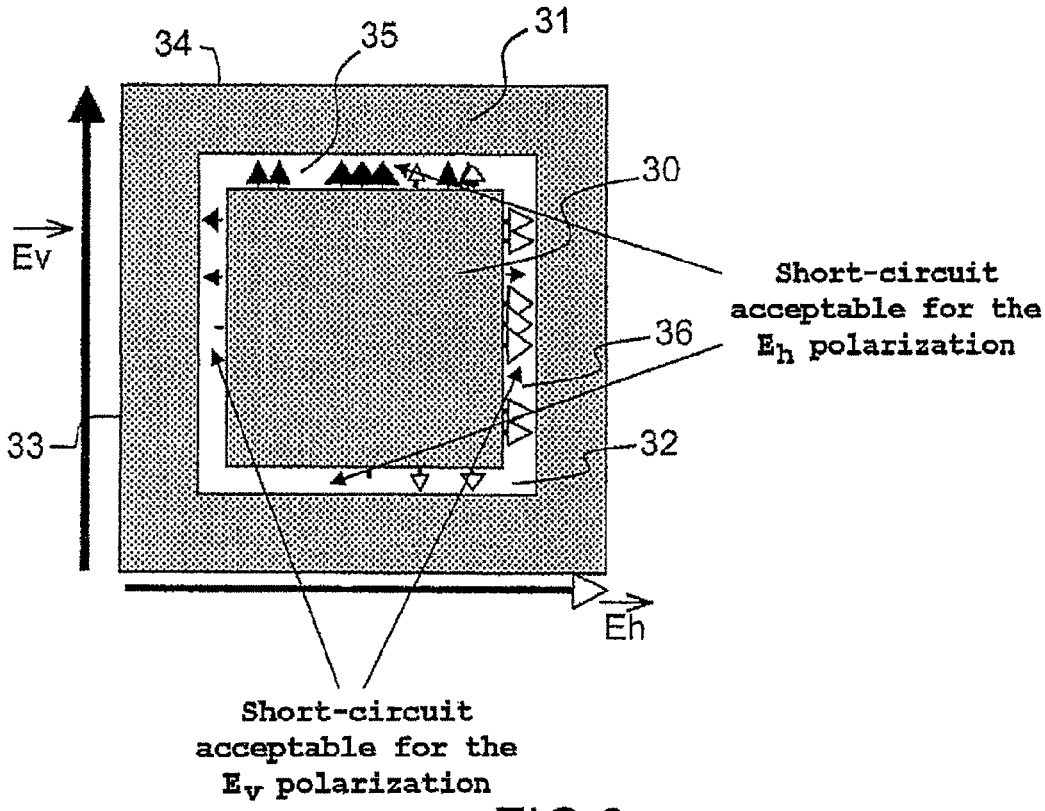
FIGS. 3*a* and 3*b*: two diagrams, viewed from above, of a second and of a third exemplary dual-polarization elementary radiating element made by planar technology.
Figure 3B:
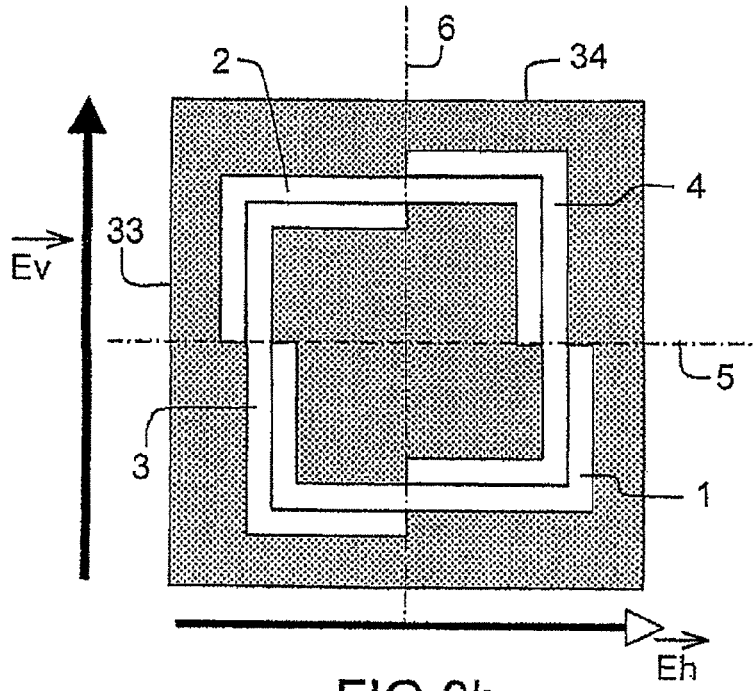

In FIG. 3*a* is represented a second exemplary dual-polarization planar radiating element. The radiating element has a polygonal shape, for example square and comprises a first internal metal patch 30, a second external annular metal patch forming a metal ring 31, and an annular slot 32 separating the external metal ring 31 and the internal metal patch 30. The internal patch, the ring and the slot are concentric. When the radiating element is polarized orthogonally by two exciter waves, the two electric fields Ev and Eh corresponding to the two directions of polarization are mutually orthogonal. The field Ev is parallel to a first side 33 of the radiating element and the field Eh is parallel to a second side 34 of the radiating element, the first and second sides 33, 34 being mutually orthogonal. The annular slot 32 is resonant when its circumference is equal to the period of the mode of polarization which is set up. Thus, as shown by FIG. 3*a*, the electric field Ev is a maximum in certain regions 35 of the slot where the electric field Eh is a minimum and disappears in other regions 36 where the electric field Eh is a maximum. The regions where one of the fields Ev, respectively Eh, progressively disappears are the regions where the external ring is parallel to the corresponding direction of polarization. At the locations where the electric field Ev, respectively Eh, disappears, it is possible to place a short-circuit between the internal patch and the external ring since this will have no effect on the response of the radiating element subjected to a wave polarized according to this mode. Indeed, as represented in FIG. 3*b*, for each polarization, the annular slot 32 is equivalent to two half-slots having the shape of two complementary half-annuli disposed symmetrically with respect to the perpendicular bisector of the side parallel to the corresponding polarization. Thus, for the polarization Ev, the annular slot 32 is equivalent to the two half-slots 1, 2 disposed symmetrically with respect to the perpendicular bisector 5 of the side 33. Likewise for the polarization Eh, the annular slot 32 is equivalent to the two half-slots 3, 4 disposed symmetrically with respect to the perpendicular bisector 6 of the side 34. The four half-slots consisting of four interleaved half-annuli represented in FIG. 3*b* therefore behave, for each polarization Ev, Eh, in a manner equivalent to an annular slot as represented in FIG. 3*a*.

Figure 4:
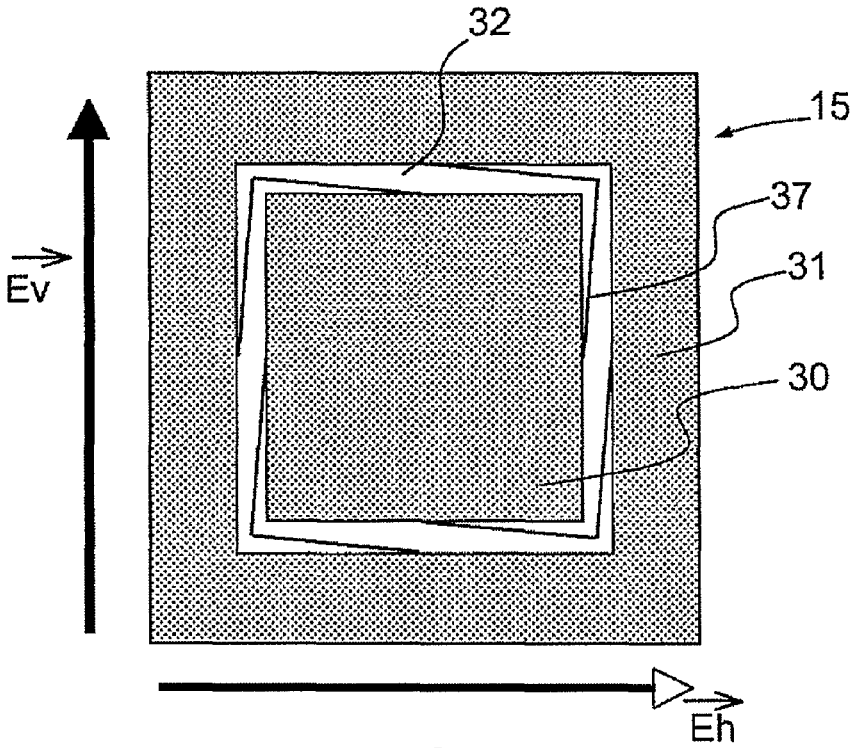
FIGS. 4, 5*a*, 5*b*: three schematic views from above of three exemplary radiating elements, according to the invention.

The radiating elements represented in FIGS. 3*a* and 3*b* also have the same behaviour as a radiating element which comprises short-circuits between the internal patch and the external ring at the locations where the electric field Ev, respectively Eh, disappears, as represented in FIG. 4. In this example, according to the invention, each side of the internal metal patch 30 is linked electrically, for example by means of a metal wire 37, to a side of the external ring 31 which is orthogonal to it. Preferably, the metal wire 37 links the middle of the side of the internal metal patch 30 to the middle of the side of the external ring 31 which is orthogonal to it. Away from resonance, short-circuiting the slots in any way whatsoever does not significantly modify the properties of the radiating element. When the slots are close to resonance, this electrical connection has only little effect on the response of the radiating element when it is excited by an orthogonally polarized wave such that each direction of polarization is parallel to one of the sides of the patch and of the external ring. Indeed, the electric field corresponding to each direction of polarization is a maximum in the regions of the slots perpendicular to the said direction of polarization and is very weak, or indeed zero in the regions of the slots parallel to the said direction of polarization.

When each side of the internal patch is linked to the external ring as described above, the spurious electrostatic charges which appear on the internal patch are drained towards the external ring. It then suffices to link the external ring of the radiating element to the metal mass of the antenna or of the radiating array on which it is mounted so as to remove the electrostatic charges.

Figure 5A:
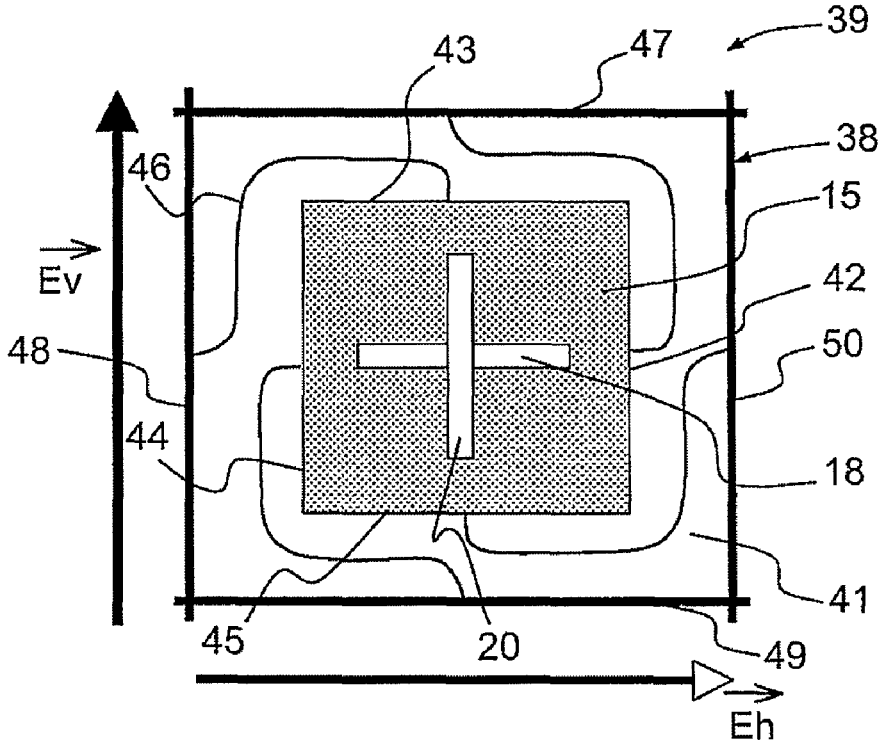

As represented in FIG. 5*a*, when integrating the radiating element into a radiating array, an external metal grid can be added to drain the electrostatic charges towards a metal ground plane of the array such as the ground plane 17 of the radiating elements.

Figure 5B:
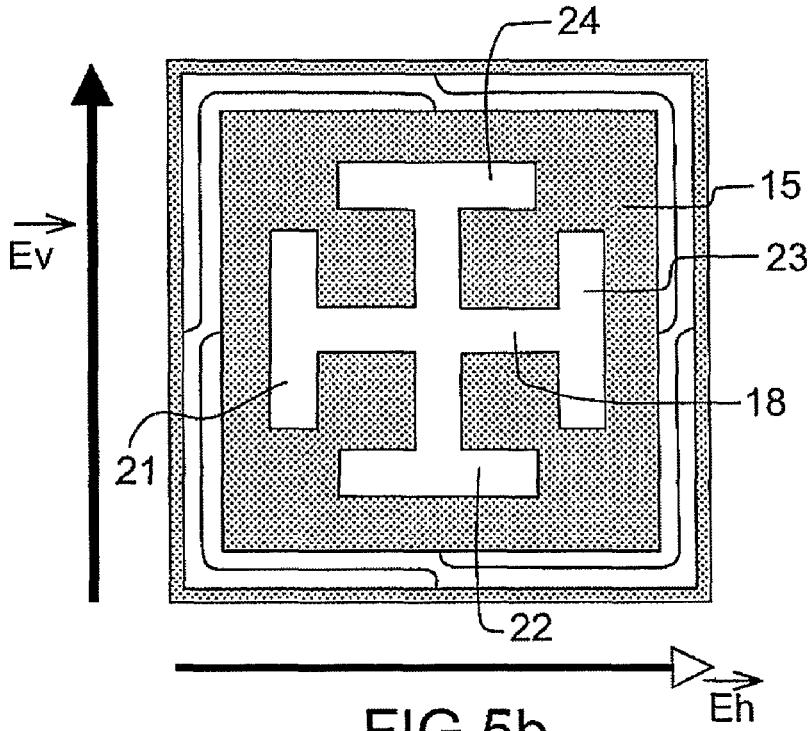

The radiating element represented in FIG. 5*a* comprises a metal patch 15, for example square-shaped, in which are made two orthogonal slots 18, 20 forming a cross. The cross is routinely positioned at the centre of the metal patch and is such that each slot is parallel to two opposite sides of the square. Alternatively, the cross can comprise additional orthogonal slots 21, 22, 23, 24 such as for example a cross, called a Jerusalem cross, represented in FIG. 5*b* which comprises four additional slots respectively placed orthogonally to the two ends of each central slot. The radiating element 39 furthermore comprises an external metal annular grid 38 delimiting a cavity 41 between the grid and the metal patch. The external annular grid and the metal patch are concentric and of the same geometric shape. The cavity 41 behaves as a radiating slot and participates in the overall radiation. The geometric shape of the patch represented in FIGS. 5*a* and 5*b* is a square but the invention is not limited to this type of shape. Notably, the invention also applies to patches of rectangular shape or of polygonal shape delimited by at least four pairwise opposite sides, such as a hexagon, or cross-shaped. According to the invention, each side 42, 43, 44, 45 of the internal metal patch is linked electrically, for example by means of a metal wire 46, to a side 47, 48, 49, 50 of the external grid 38 which is orthogonal to it. Preferably, the metal wire links the middle of the side of the internal metal patch to the middle of the side of the external grid which is orthogonal to it. The same reasoning as that applied with the example of FIG. 4 remains valid on replacing the metal ring 31 with the metal grid 38.

When each side of the internal patch is linked to the external grid as described above, the spurious electrostatic charges which appear on the patch are drained towards the external grid. It then suffices to link the external grid of the radiating element to the metal mass of the antenna or of the radiating array on which it is mounted so as to remove the electrostatic charges.

Figure 6:
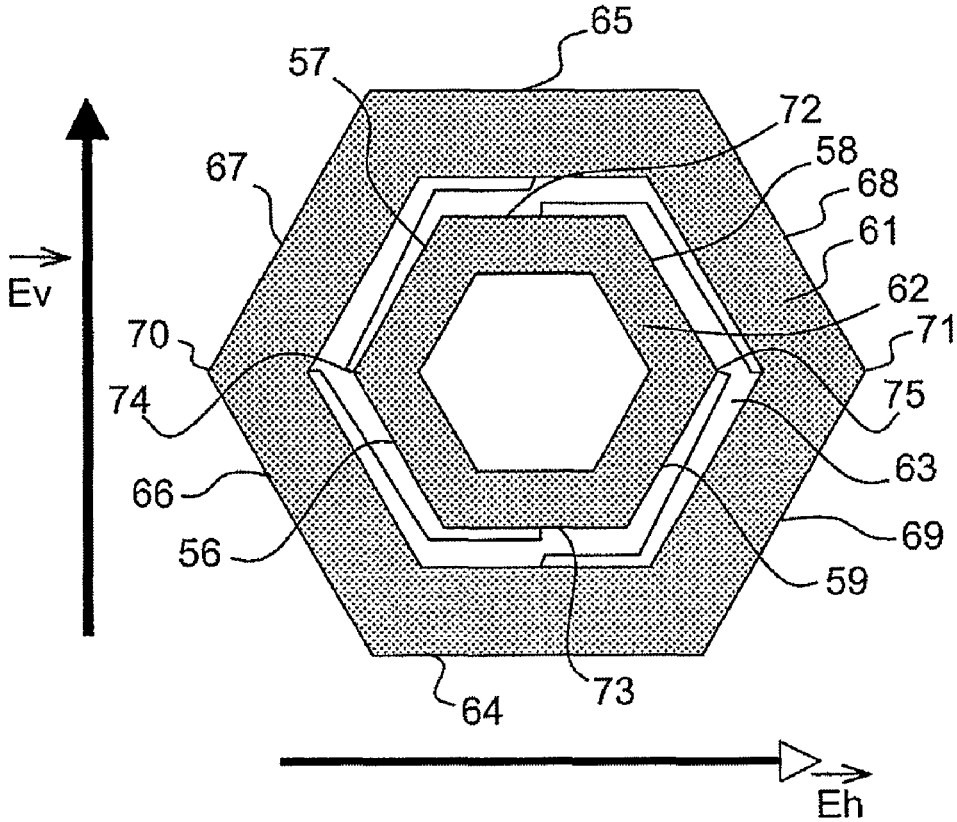
FIG. 6: a schematic view from above of a fourth exemplary radiating element, according to the invention.

FIG. 6 represents a third exemplary radiating element according to the invention. In this example, the geometric shape of the radiating element is hexagonal and comprises 6 pairwise opposite sides. This radiating element comprises two concentric annular metal patches 61, 62 spaced apart by an annular slot 63. When this radiating element is excited by an orthogonally polarized wave such that one of the directions of polarization Eh is parallel to two opposite sides 64, 65 of the hexagon, the field Ev is a minimum in the regions of the external patch perpendicular to the field Ev, that is to say the regions of the vertices of the hexagon where the sides 66, 67, 68, 69 which are not parallel to any direction of polarization meet. Thus, each side 72, 73 of the internal patch 62 parallel to one of the directions of polarization Eh is linked electrically to a vertex 70, 71 of the external patch 61 where the sides 66, 67 and 68, 69 which are not parallel to any direction of polarization meet. Likewise, a vertex 74, 75 of the internal patch 62 where the sides 56, 57, 58, 59 which are not parallel to any direction of polarization meet is linked electrically to a side 65, 64 of the external patch 61 parallel to a direction of polarization Eh. As in the previous examples, when integrating the radiating element into a radiating array, an external metal grid, not represented, is added to drain the electrostatic charges towards a metal ground plane of the array such as the ground plane 17 of the radiating elements.

Figure 7:
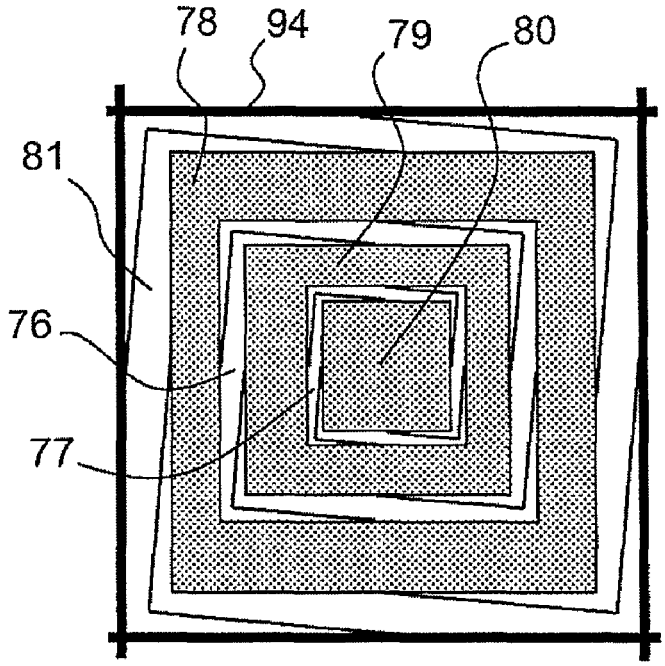
FIGS. 7 and 8: two schematic views from above of a fifth and of a sixth exemplary radiating element, according to the invention.
Figure 8:
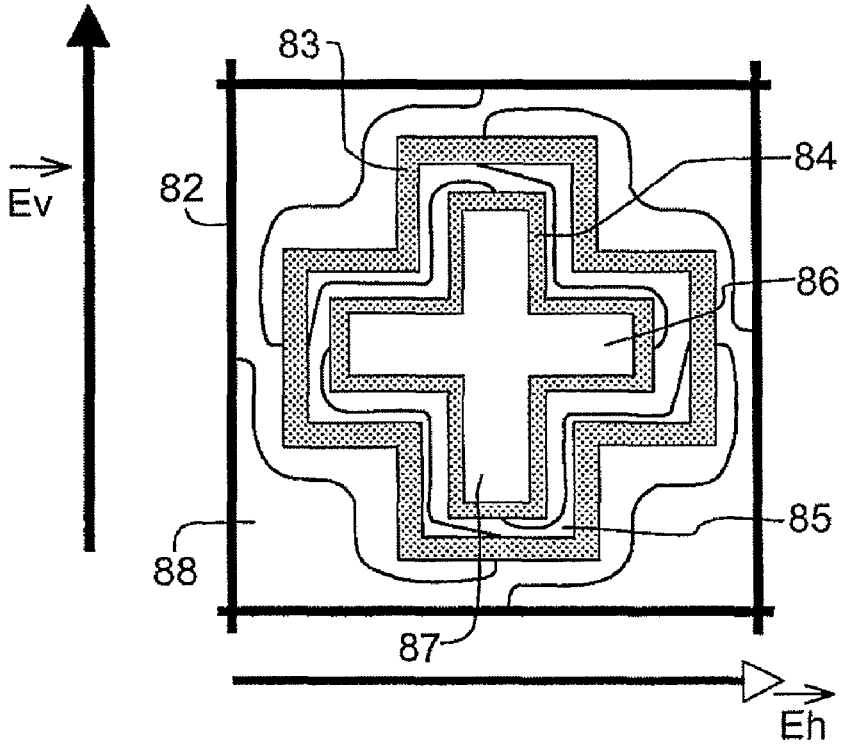

The same principle also applies in respect of radiating elements comprising several annular slots 76, 77 and several concentric metal patches 78, 79, 80, each annular slot separating two adjacent patches such as represented in FIGS. 7 and 8. In this case, each side of a first internal metal patch 80 parallel to a direction of polarization is linked electrically to an orthogonal side of a second annular metal patch 79 which surrounds it, and each side of the second annular metal patch 79 parallel to a direction of polarization is linked electrically to an orthogonal side of a third metal patch 78 which surrounds it. And so on and so forth for each of the metal patches in such a way that all the metal patches internal to an annular metal patch which surrounds it have each of their sides parallel to a direction of polarization linked to an orthogonal side of the annular metal patch which surrounds it. Furthermore, the radiating element can comprise an external annular metal grid 94 separated from the external annular patch 78 by a cavity 98. In this case, as described previously in conjunction with FIG. 5, each side of the third external metal patch 78 is linked electrically to a side of the external grid 94 which is orthogonal to it.

In FIG. 8 the radiating element comprises a square-shaped external grid 82 and a central cross, spaced from the external grid by a cavity 88. The central cross comprises two cross-shaped annular metal patches 83, 84 separated by a cross-shaped annular slot 85, and two orthogonal slots 86, 87 forming a cross, positioned at the centre of the radiating element. The various crosses are such that each slot 85, 86, 87 comprises regions parallel to a first direction of polarization Ev and regions parallel to a second direction of polarization Eh. Likewise, each annular metal patch 83, 84 and the grid 82 comprises sides which are parallel and sides which are orthogonal to the first direction of polarization Ev as well as sides which are parallel and sides which are orthogonal to the second direction of polarization Eh. Just as for the example represented in FIG. 7, each side of a first internal metal patch 84 parallel to a direction of polarization is linked electrically to an orthogonal side of a second annular metal patch 83, or of the external metal grid 82 which surrounds it. This type of cross-shaped planar radiating element exhibits the advantage of leading to smaller dimensions than the patterns with annular slots in elements of square or circular type, since the electrical path is elongated. They can therefore be inserted into arrays of smaller mesh, this being favourable for the performance in terms of bandwidth, and thereby improving the response of the array to waves at steep incidence.

Figure 9A:
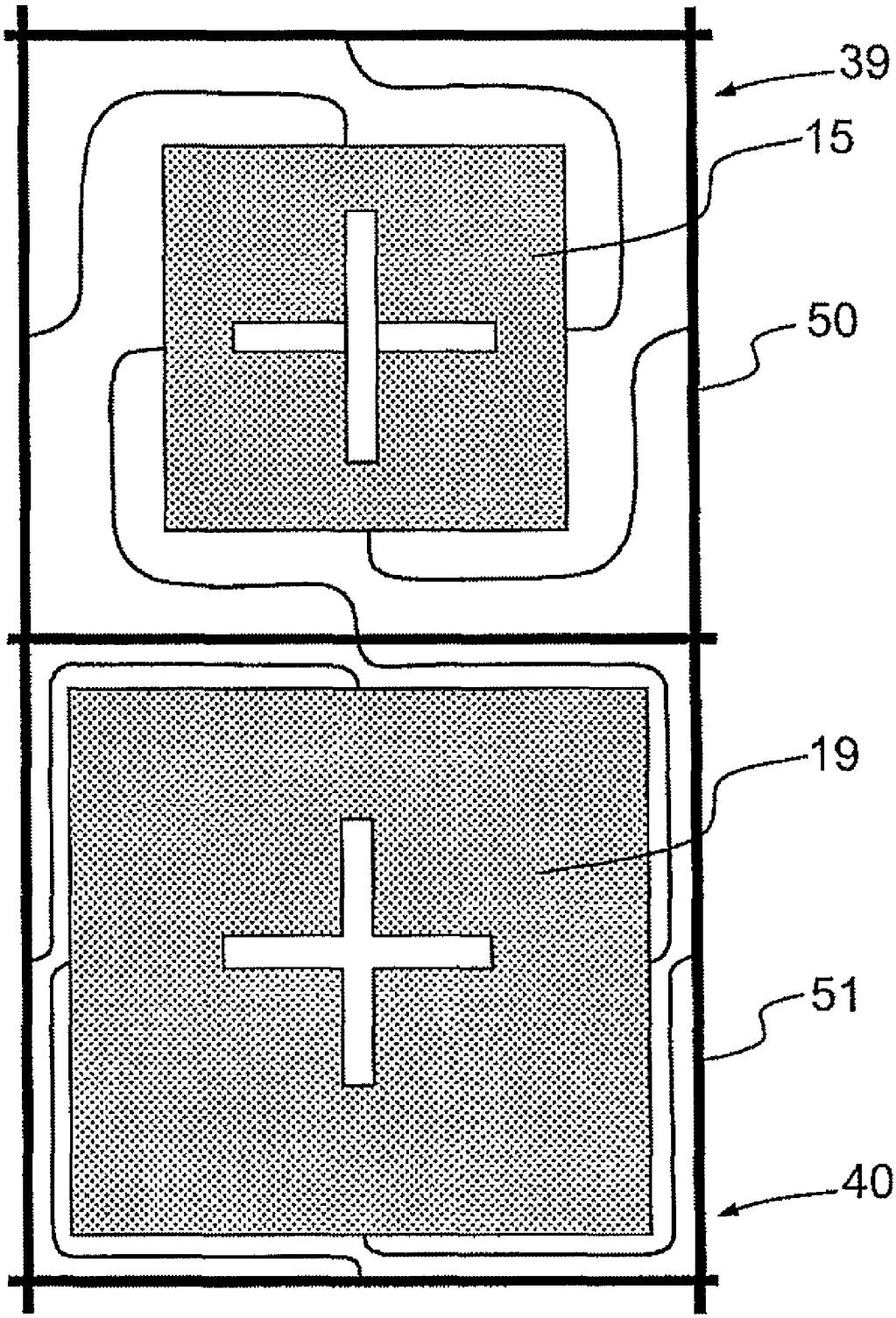
FIGS. 9*a*, 9*b*, 9*c*: three schematic views from above of three exemplary radiating arrays, according to the invention.
Figure 9B:
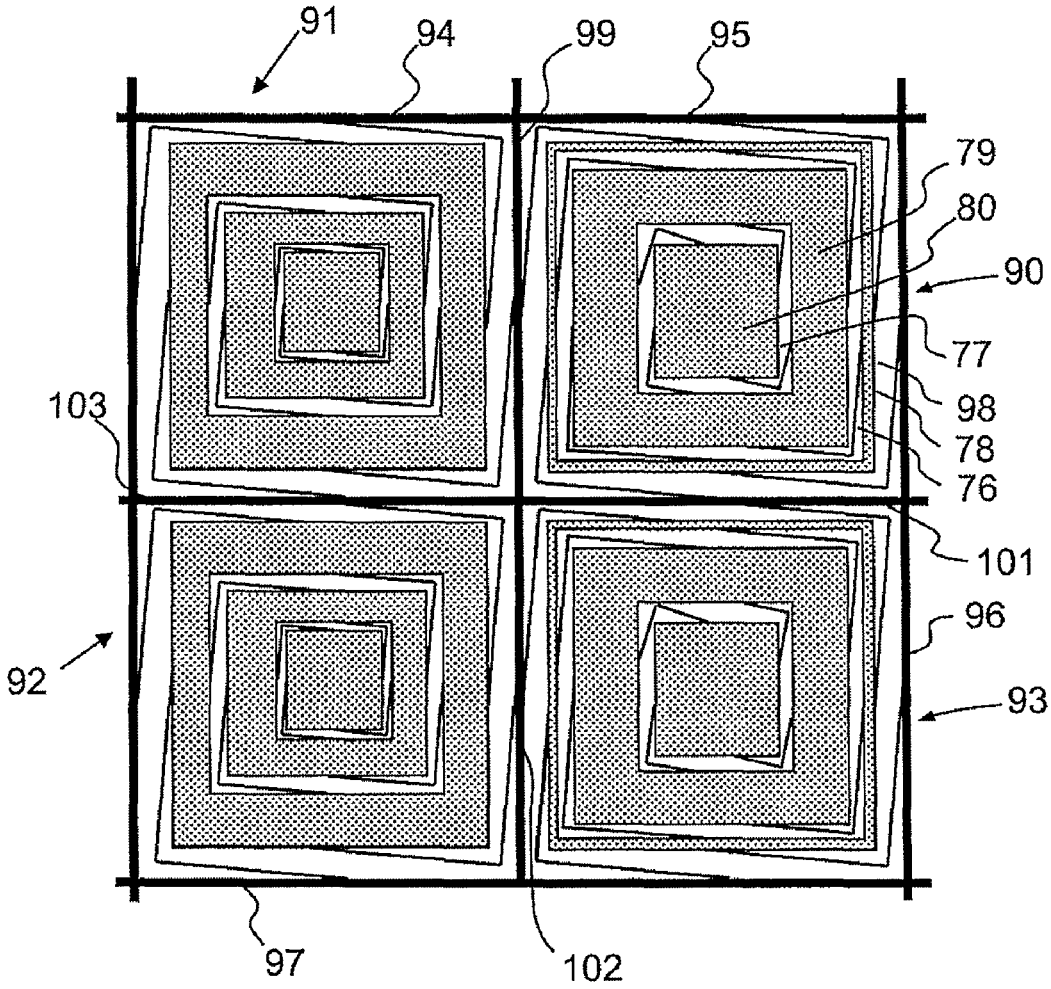
Figure 9C:
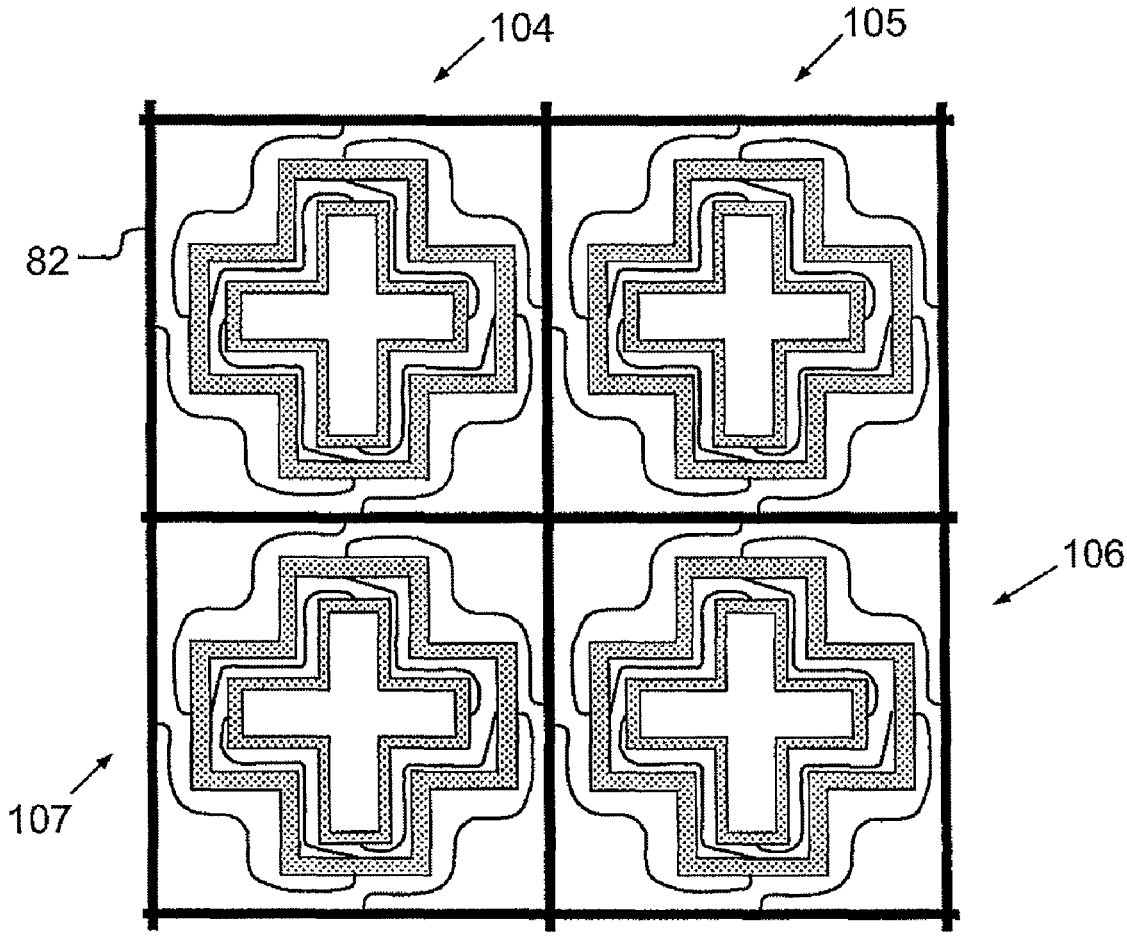

FIGS. 9*a*, 9*b*, 9*c* represent three exemplary radiating arrays, according to the invention. The array of FIG. 9*a* comprises two dual-polarization planar radiating elements, each radiating element 39, 40 comprising a metal patch 15, 19 and an external grid spaced from the patch by a cavity. The two radiating elements are adjacent and the two external grids 50, 51 comprise a side 49 in common. Each side of the metal patch is linked electrically to an orthogonal side of the external grid.

The arrays of FIGS. 9*b* and 9*c* comprise four dual-polarization planar radiating elements. In FIG. 9*b*, each radiating element 90, 91, 92, 93 comprises an internal metal patch 80, a first annular metal patch 79 spaced from the internal patch by a first annular slot 77, a second annular metal patch 78 spaced from the first annular patch 79 by a second annular slot 76, an annular metal grid 94, 95, 96, 97 spaced from the second annular metal patch 78 by a cavity 98. The four radiating elements are mutually adjacent and the four grids comprise pairwise common sides 99, 101, 102, 103.

In FIG. 9*c*, each radiating element 104, 105, 106, 107 comprises two central slots 86, 87 in the shape of a cross, a first internal annular patch 84 surrounding the central cross, a second annular patch 83 external to the first annular patch 84 and spaced from the latter by an annular slot 85 and an external annular metal grid 82 of square shape and spaced from the second annular metal patch 83 by a cavity 88, as in FIG. 8. The four radiating elements are mutually adjacent and the four grids comprise pairwise common sides.

Each metal patch comprises sides which are parallel to a direction of polarization and linked to an orthogonal side of a metal patch which surrounds it or for the second annular patch, to an orthogonal side of the external metal grid. All the electrostatic charges are thus drained towards the external metal grid without disturbing the response of the radiating elements subjected to an orthogonally polarized wave. The electrostatic charges are thereafter discharged towards a metal ground plane of the array by linking the grid external to this metal ground plane.

A radiating array of various sizes and of various characteristics can thus be made by combining a plurality of radiating elements to constitute a one-dimensional or two-dimensional radiating surface of desired size. The elements may all be identical or may be of different structures depending on the type of antenna desired. The array can thereafter be fitted into a chosen array antenna such as for example that represented in FIG. 1 or any other type of array antenna.

Although the invention has been described in conjunction with particular embodiments, it is quite obvious that it is in no way limited thereto and that it comprises all the technical equivalents of the means described as well as their combinations if the latter enter within the framework of the invention. In particular, all the combinations of solid or annular patches and of orthogonal central slots in the shape of a cross can be made, the cross being able to comprise a number of orthogonal slots greater than or equal to two, such as for example the simple cross or the Jerusalem cross. Likewise, a planar radiating element having a hexagonal geometric shape or cross-shaped can comprise an external grid of different shape, for example of square shape. Furthermore, radiating elements of hexagonal shape can comprise an internal patch having orthogonal central slots forming a simple cross or a Jerusalem cross.

What is claimed is:

1. A dual-polarization planar radiating element, comprising:

an external metal grid, at least one metal patch concentric with the external metal grid and a cavity separating the metal grid and the metal patch, the grid and the patch having a polygonal shape delimited by at least four pairwise opposite sides, two orthogonal directions of polarization associated with two orthogonal electric fields Ev and Eh, at least one of the directions of polarization being parallel to two sides of the polygon, wherein each side of the metal patch parallel to a direction of polarization is linked electrically to a zone of the external grid where one of the electric fields Ev or Eh is a minimum.

2. The planar radiating element according to claim 1, wherein the polygonal shape of the metal patch is chosen from among a square, rectangle, cross or hexagon shape.

3. The planar radiating element according to claim 2, having four pairwise orthogonal sides and wherein each side of the metal patch parallel to a direction of polarization is linked respectively to a side of the external grid perpendicular to the said direction of polarization.

4. The planar radiating element according to claim 3, wherein each side of the metal patch parallel to a direction of polarization comprises a centre linked to a centre of a side of the external grid perpendicular to the said direction of polarization.

5. The planar radiating element according to claim 2, wherein the metal patch further comprises an external annular patch, at least one internal patch concentric with the external annular patch and at least one annular slot separating the internal and external patches, the internal and external patches having a hexagon shape comprising two sides parallel to a direction of polarization and four sides inclined obliquely with respect to the said direction of polarization and linked pairwise by a vertex, wherein each side of the external metal patch parallel to the said direction of polarization is linked electrically to a vertex of the internal patch and wherein each side of the internal patch parallel to the said direction of polarization is linked electrically to a vertex of the external metal patch.

6. The planar radiating element according to claim 1, wherein the metal patch further comprises at least two orthogonal slots forming a central cross.

7. The planar radiating element according to claim 1, wherein the metal patch further comprises an external annular patch, at least one internal patch concentric with the external annular patch and at least one annular slot separating the internal and external patches, the internal and external patches having the same polygonal shape and in that each side of the internal patch parallel to a direction of polarization is linked to a side of the external annular patch perpendicular to the said direction of polarization.

8. The planar radiating element according to claim 7, wherein each side of the internal patch parallel to a direction of polarization comprises a centre linked to a centre of a side of the external annular patch perpendicular to the said direction of polarization.

9. The planar radiating element according to claim 7, wherein the internal patch comprises at least two orthogonal slots forming a central cross.

10. The planar radiating element according to claim 7, wherein the polygonal shape of the metal patches is a cross shape and the external grid has a square shape.

11. An array antenna, comprising at least one dual-polarization planar radiating element according to claim 1 wherein the external metal grid of each radiating element is linked to a metal ground plane of the array.

* * * * *